US007699619B2

(12) United States Patent
Mizumura

(10) Patent No.: US 7,699,619 B2
(45) Date of Patent: Apr. 20, 2010

(54) SOCKET FOR CAMERA MODULE

(75) Inventor: Akinori Mizumura, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/883,401

(22) PCT Filed: Jan. 26, 2006

(86) PCT No.: PCT/US2006/002776

§ 371 (c)(1),
(2), (4) Date: Apr. 10, 2008

(87) PCT Pub. No.: WO2006/083670

PCT Pub. Date: Aug. 10, 2006

(65) Prior Publication Data

US 2008/0194122 A1 Aug. 14, 2008

(51) Int. Cl.
*H01R 12/00* (2006.01)

(52) U.S. Cl. ..... 439/71; 439/607.35

(58) Field of Classification Search ..... 439/71, 439/73, 607, 331, 246–248, 607.01, 607.31–607.4
See application file for complete search history.

(56) References Cited

U.S. PATENT DOCUMENTS

| | | | | |
|---|---|---|---|---|
| 4,035,046 | A | 7/1977 | Kloth | |
| 4,616,895 | A | 10/1986 | Yoshizaki et al. | |
| 4,668,032 | A | 5/1987 | Bouvier et al. | |
| 5,857,858 | A | 1/1999 | Gorowitz et al. | |
| 6,164,980 | A | 12/2000 | Goodwin | |
| 6,435,882 | B1 | 8/2002 | Pitou | |
| 6,439,909 | B1 * | 8/2002 | Polgar et al. | 439/248 |
| 6,862,804 | B2 | 3/2005 | Nishio et al. | |
| 6,905,344 | B2 | 6/2005 | Nishio et al. | |
| 6,921,271 | B2 | 7/2005 | Liao et al. | |
| 6,939,172 | B2 * | 9/2005 | Lu | 439/607 |
| 7,029,308 | B2 | 4/2006 | Wada | |
| 7,077,663 | B2 | 7/2006 | Nishio et al. | |

(Continued)

FOREIGN PATENT DOCUMENTS

CN 20040024678.5 5/2005

(Continued)

OTHER PUBLICATIONS

International Search Report in PCT Application No. PCT/US2006/002776, Jan. 26, 2006.

(Continued)

*Primary Examiner*—Xuong M Chung-Trans
(74) *Attorney, Agent, or Firm*—Timothy M. Morella

(57) ABSTRACT

A socket for a camera module includes an insulative terminal assembly housing that supports a plurality of conductive terminals. The housing serves as the bottom of a socket and it is surrounded with a conductive metal shell that defines a cavity which receives a camera module. The shell has one or more elastic arms that extend into contact with the housing. The shell is movable on the housing, and the housing has one or more projections that serve as stops for the elastic arms to limit the vertical movement of the shell with respect to the housing. This vertical movement permits the shell to move relative to the housing and thereby compensate for warping and the like which may occur on circuit boards to which the socket is mounted.

9 Claims, 16 Drawing Sheets

U.S. PATENT DOCUMENTS

| | | | | |
|---|---|---|---|---|
| 7,077,680 | B1 | 7/2006 | Wang et al. | |
| 7,112,083 | B2 * | 9/2006 | Nishio et al. | 439/331 |
| 7,147,481 | B2 | 12/2006 | Yang | |
| 7,261,597 | B2 * | 8/2007 | Li | 439/607 |
| 7,261,599 | B2 | 8/2007 | Li | |
| 7,288,003 | B2 | 9/2007 | Ono et al. | |
| 2003/0218873 | A1 * | 11/2003 | Eromaki et al. | 361/816 |
| 2004/0023528 | A1 | 2/2004 | Nishio et al. | |
| 2004/0247311 | A1 | 12/2004 | Ajiki et al. | |
| 2006/0051986 | A1 | 3/2006 | Asai et al. | |
| 2006/0189183 | A1 | 8/2006 | Yang | |
| 2006/0189216 | A1 | 8/2006 | Yang | |

FOREIGN PATENT DOCUMENTS

| | | |
|---|---|---|
| EP | 03017380.1 | 7/2003 |
| EP | 04015399.1 | 2/2004 |
| EP | 04251905.8 | 10/2004 |
| JP | 2002100440 | 12/2000 |
| JP | 2003092168 | 9/2001 |
| WO | WO 03/101162 | 12/2003 |
| WO | WO 2006/042133 | 4/2006 |
| WO | WO 2006/083670 | 8/2006 |
| WO | WO 2007/041484 | 4/2007 |
| WO | WO 2008/030492 | 3/2008 |

OTHER PUBLICATIONS

International Search Report for PCT/US2003/016726.
International Search Report for PCT/US2006/002776.
International Search Report for PCT/US2006/036203.
International Search Report for PCT/US2006/038415.
International Search Report for PCT/US2007/019393.

* cited by examiner

SOCKET FOR CAMERA MODULE

BACKGROUND OF THE INVENTION

The present invention relates generally to sockets for camera modules, and more particularly to a socket in which the outer shell is movable with respect to the inner terminal assembly.

Conventionally, module sockets have been used to mount camera modules, which are typically composed of an image capturing element, such as a CCD (Charge Coupled Device) or a CMOS (Complementary Metal Oxide Semiconductor) and an optical lens. These two elements are integrated together and mounted to a substrate of a small-sized electronic device such as a cellular phone or a PDA (Personal Digital Assistance) (see, for example, Japanese Design Registration No. 1179175).

FIG. 2 is an exploded perspective view of such a conventional module socket that is used in small electronic devices, such as cellular telephones. In FIG. 2, the housing body 311 of the terminal assembly is made of resin and supports conductive terminals 313. The assembly is mounted on a printed circuit board 314, which serves as a substrate; and the camera module 320 is inserted into the housing body 311 for attachment. The circumferential wall of the housing body 311 is covered with the shell 312 made of metal so as to prevent electromagnetic interference ("EMI"). After the camera module 320 is placed in the housing body 311, the metal cover 301 is attached from above.

However, in this type of module socket, the cover 301 is retained from coming off of the camera module 320, and this increases the number of parts needed. Therefore, the number of steps for mounting the camera module 320 onto the printed circuit board 314 increases, along with costs for mounting. Moreover, because the housing body 311 has a side wall made of resin at each of four sides, the external dimensions increase because of the thickness of the side wall, so that the area occupied on the printed circuit board 314 increases. In particular, in small-sized electronic devices, the available surface area of the printed circuit board 314 is limited, and the large occupied area poses a serious sizing problem.

The shell 312 covers the circumferential wall of the housing body 311, and is formed by assembling two metallic plate members. If the shell is out of tolerance, the dimensional accuracy of the parts deteriorates. Particularly, because the housing body 311 and the shell 312 are fixed to each other, the flatness of the bottom surface of the module socket deteriorates, and a difference is produced between the height of the lower surface of the solder tails of the terminals 313 and the height of the lower surfaces of lower projections of the shell 312 with respect to the upper surface of the printed circuit board 314.

The module socket is used to establish electrical connection between the camera module 320 and wiring traces on the circuit board 314 as follows. The contact portions of the terminals 313 come into contact with electrodes on the bottom surface of the camera module 320, while the lower surface of the solder tails of the terminals 313 are soldered to wiring traces exposed on the circuit board 314 or pads of the wiring traces. A thin metal film is formed on the surface of the camera module 320 through plating, and is electrically connected to the shell 312 via the cover 301 or the like, so as to cope with static electricity and noise. The lower surfaces of the lower projections of the shell 312 are soldered to ground traces of the circuit board 314 or pads connected thereto so that the shell 312 is grounded. When the module socket is mounted on the circuit board 314, solder is applied to the traces or pads on the circuit board 314, and is heated for reflow soldering. The thickness of the solder in the form of a paste applied to the traces or pads is approximately 0.1 mm. Therefore, if a difference greater than 0.1 mm is present between the height of the lower surface of the solder tails of the terminals 313 and the height of the lower surfaces of lower projections of the shell 312 with respect to the upper surface of the printed circuit board 314, the lower surface of the solder tails of some terminals 313 or the lower surfaces of some lower projections of the shell 312 may fail to become soldered to the circuit board traces or pads. In such cases, electrodes of the camera module 320 may not be reliably connected to the circuit board 314, with the result that the camera module 320 fails to operate properly. In addition, since the shell 312 is not properly grounded, blocking of noise becomes incomplete.

The present invention is therefore directed to an improved camera module socket that avoids the above-mentioned shortcomings.

SUMMARY OF THE INVENTION

It is therefore a general object of the present invention to provide a camera module socket which has a reduced number of parts, reduced external dimensions, and a reduced occupying area on a substrate, which provides freedom to the vertical positional relationship between terminals and a side wall member and has improved dimensional accuracy, and which enables easy, reliable mounting of a module at low cost.

It is another object of the present invention to provide a camera module socket that utilizes an outer grounding shell that contacts the camera module and which is loosely fixed to the base member of the terminal assembly, thereby permitting a slight amount of movement between the shell and the terminal assembly in order to compensate for out of tolerance circuit boards and the like.

It is still another object of the present invention to provide a socket for a camera module which includes an inner terminal assembly having an insulative base member and a plurality of conductive terminals, and a conductive socket that encloses the base member, the socket having pairs of retention arms that engage sides of the terminal assembly base member, the base member having stops that permit movement of the retention arms on the base member so that the socket can "float" in its engagement to the base member.

The present invention accomplished these and other objects by way of its structure. The module socket includes a base member formed of an insulating material, and a side wall member, or shell, formed from a single metal plate. The shell is attached to the base member so as to form a side wall which extends perpendicular to the base member, and surrounds the circumference of the base member, whereby a socket in the form of a bottomed container is formed. The shell is attached to the base member such that the shell is movable with respect to the bottom member in the height direction.

Terminals are mounted to the base member and the shell is attached to the base member to be movable in the vertical direction, the shell entirely surrounding at least a portion of a side surface of the module in the circumferential direction, the portion extending over a predetermined range in the height direction. The terminals and the shell are connected to an upper surface of a substrate.

Preferably, the shell includes an elastic engagement piece in the form of an inwardly projecting first arm, the first arm engaging recesses formed on the side surfaces of the module to thereby lock the module in place within the shell. Preferably, the first arm is a tongue-shaped member having one end connected to a body of the shell, wherein portions of the body of the shell sandwich a portion of the body to which the elastic engagement piece is connected function as torsion springs.

Preferably, the shell includes a second arm projecting inward, the second arm contacting a metal coating layer formed on the side surface of the module to thereby shield the module. Preferably, the terminals each include an elastic arm portion projecting upward from the bottom member and coming into contact with a wiring trace on the bottom surface of the module.

The shell also includes a third arm, and the base member includes an engagement projection which opposes the third arm. The third arm comes into engagement with the engagement projection such that the third arm is movable vertically for a predetermined distance. Preferably, the engagement projection includes upper and lower engagement projections and formed on a side surface of the base member, wherein the upper engagement projection comes into contact with the upper end of the third arm so as to restrict upward movement of the shell with respect to the base member, and the lower engagement projection comes into contact with the lower end of the third arm so as to restrict downward movement of the shell with respect to the base member.

The module socket according to the present invention has a reduced number of parts, reduced external dimensions, and a reduced occupying area on a substrate; provides freedom to the vertical positional relationship between terminals and its shell member and has improved dimensional accuracy; and enables easy, reliable mounting of a module at low cost.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
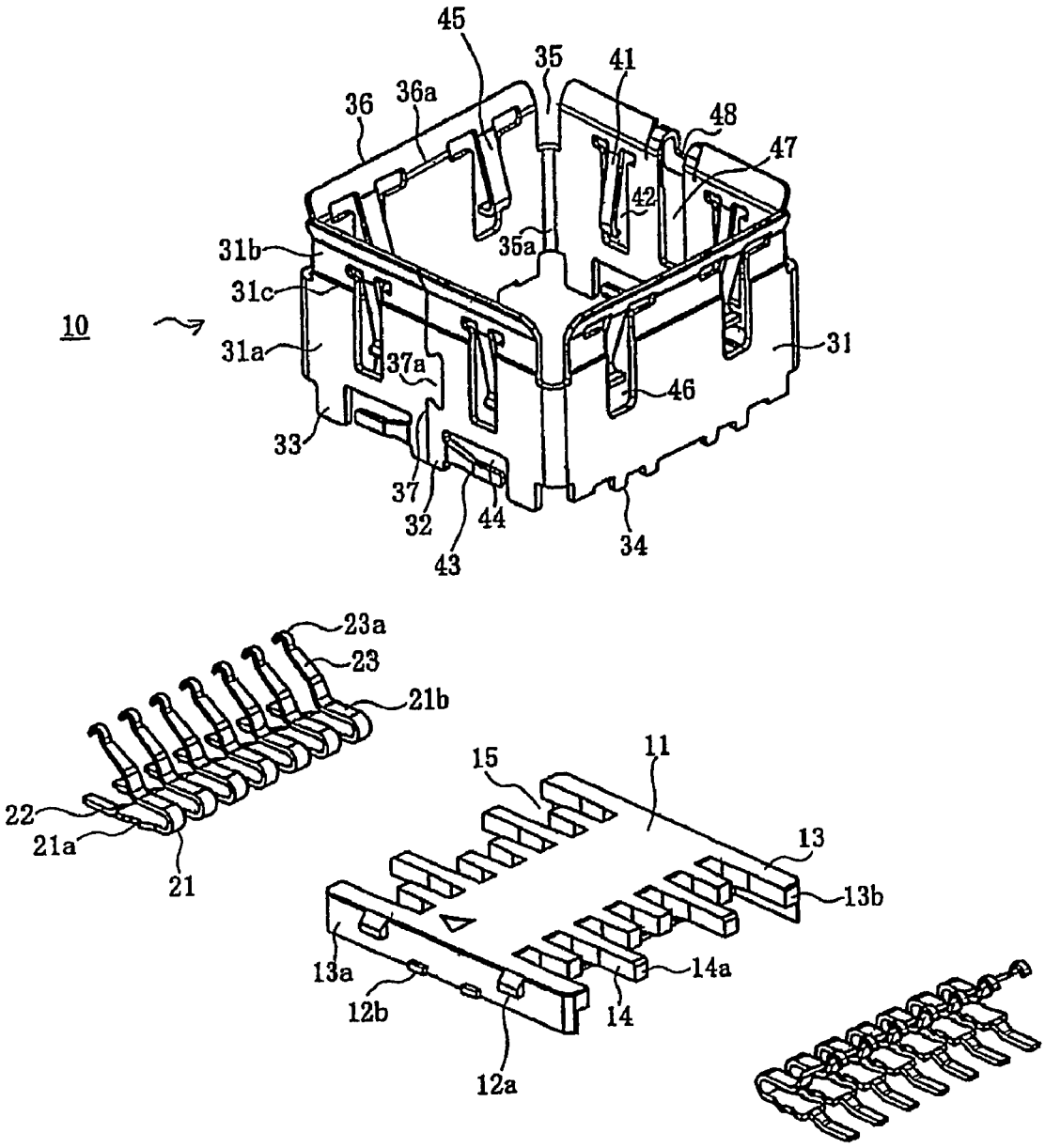
FIG. 1 is an exploded perspective view of a camera module socket constructed in accordance with the principles of the present invention.
Figure 2:
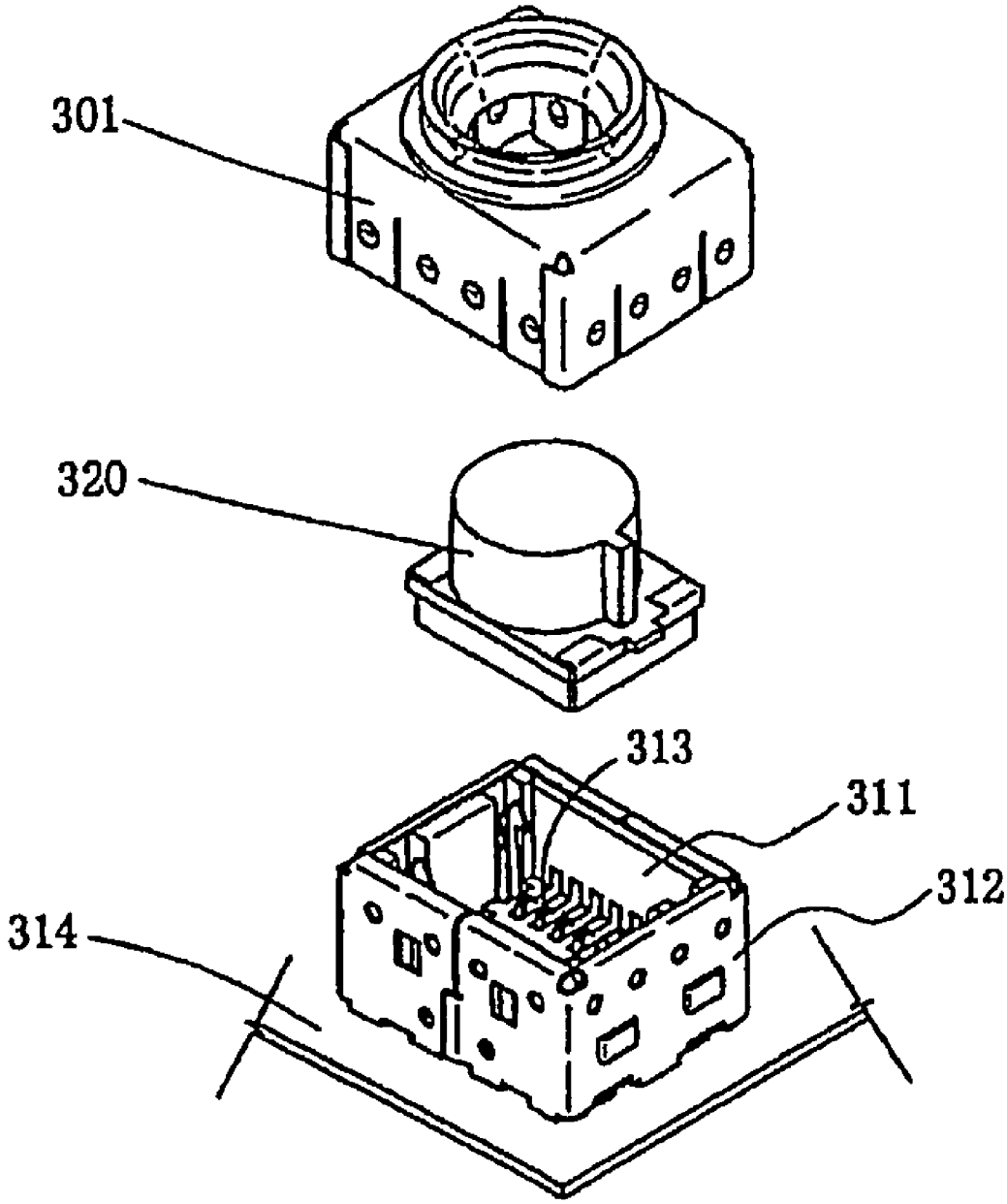
Prior art FIG. 2
FIG. 2 is an exploded perspective view of a conventional camera module socket.

FIG. 1 illustrates a camera module socket 10 constructed in accordance with the principles of the present invention, and which is used to electrically connect a module to a substrate 51. The module 53 is preferably a camera module, which is composed of an image capturing element (e.g., a CCD or a CMOS image sensor) and an optical lens which integrated together as a single component. However, the module 53 may be a module of any type, such as a sensor module including a sensor (e.g., an infrared sensor or a fingerprint reading sensor) or an acoustic element module (e.g., a microphone). The camera module socket 10 is used to mount the camera module 53 to a small-sized electronic device such as a cellular phone or a PDA. The camera module socket 10 may be used to mount the module 53 to other apparatuses, such as home appliances (e.g., a television, a washer, or a refrigerator), monitoring apparatuses for security, and automobiles. The camera module socket 10 is mounted to a substrate such as a printed circuit board, however, no limitation is imposed on the type of the substrate.

In the description of the present embodiment, terms for expressing direction, such as up, down, left, right, front, and rear, are for explaining the structure and action of portions of the ; camera module sockets 10. However, these terms represent respective directions for the case where the camera module socket 10 is used in an orientation shown in the drawings, and must be construed to represent corresponding different directions when the orientation of the camera module socket 10 is changed.

As shown in FIG. 1, the camera module socket 10 is adapted to receive the camera module 53 and includes a terminal assembly that includes an insulative housing or base member 11 and conductive terminals 21 that are supported by the base member 11. A conductive shell 31 is attached to the housing member 11. The socket 10 assumes the form of a bottomed container having an opened upper end. The shell 31 entirely surrounds at least a portion of a side surface 55 of the module 53 in the circumferential direction, the portion extending over a predetermined range in the height direction. That is, the shell 31 is not required to cover the side surface 55 of the module 53 over the entire range in the height direction, from the lower end to the upper end of the side surface 55, but is only required to cover the side surface 55 over a portion of the range. Notably, the present embodiment will be described with reference to the case where the above-mentioned bottomed container assumes a generally parallelepiped shape; that is, the case where the shell 31 assumes the form of a rectangular tube, one end of which is closed by means of the housing member 11, and the other end of which is opened.

The housing member 11 has a low profile and is formed of an insulating material such as synthetic resin, and preferably without any side walls. At opposite lateral ends of the body portion of the housing member 11, there are end projections 13 and intermediate projections 14 formed to extend laterally outward. The number of the intermediate projections 14 is shown as two for each side, however, others may be used. Side surfaces 13*a* of the end projections 13 are flush with the corresponding longitudinal end surfaces of the body of the housing member 11 and face the inner surface of the shell 31 near the lower edge thereof. The end surfaces 13*b* of the end projections 13 and end surfaces 14*a* of the intermediate projections 14 extend along a direction perpendicular to the side surfaces 13*a* and face the inner surface of the shell 31 in the vicinity of the lower edge thereof.

Upper and lower engagement projections 12*a* and 12*b*, which come into engagement with engagement arms 43 of the shell 31 (described later) are formed on the side surfaces 13*a* of the end projections 13, or on the opposite end surfaces of the body of the housing member 11 with respect to the longitudinal direction thereof. The upper and lower engagement projections 12*a* and 12*b* project outward from the opposite longitudinal end surfaces of the body of the housing member 11. The lower ends of the upper engagement projections 12*a* come into engagement with upper ends of the corresponding engagement arms 43 so as to restrict upward movement of the shell 31 with respect to the housing member 11. The upper ends of the lower engagement projections 12*b* come into engagement with lower ends of the corresponding engagement arms 43 so as to restrict downward movement of the shell 31 with respect to the housing member 11. Notably, an inclined surface or tapered surface is preferably formed on the upper end of each upper engagement projection 12*a* so as to enable the corresponding engagement arm 43 to easily pass over the upper engagement projection 12*a*. When the upper and lower engagement projections 12*a* and 12*b* are collectively described, they are referred to as "engagement projections 12."

Figure 6:
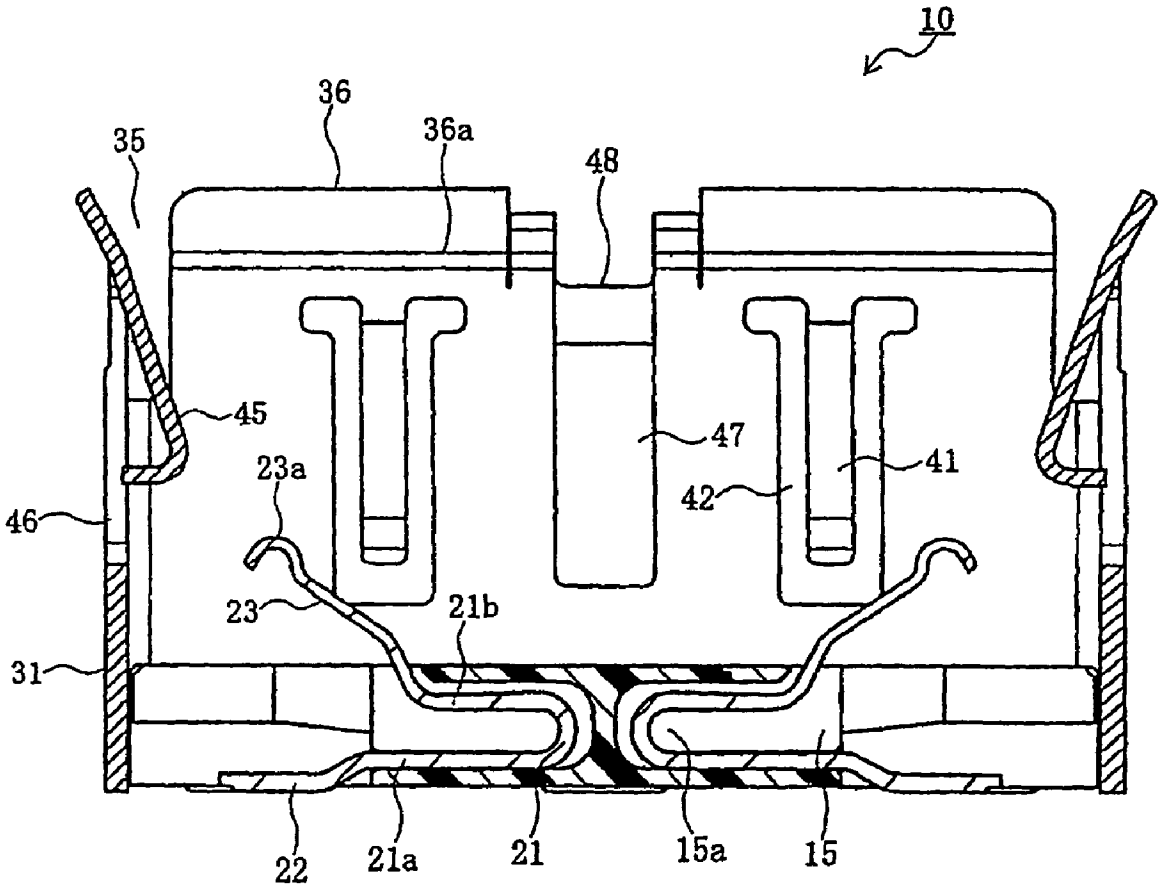
FIG. 6 is a sectional view of the camera module socket taken along line A-A of FIG. 3.

At the opposite lateral ends of the body portion of the housing member 11, seven terminal-receiving grooves 15 are shown as being formed at a predetermined pitch such that the terminal-receiving grooves 15 extend laterally. A single terminal is shown disposed in each terminal-receiving groove 15. The pitch and number of the terminal-receiving grooves 15 can be determined freely. The terminals 21 are not necessarily required to be disposed in all the terminal-receiving grooves 15, and some of the terminals 21 may be omitted in accordance with the arrangement of signal wiring traces exposed at a bottom surface 56 of the module 53. As shown in FIG. 6, recesses 15*a* are formed in the body of the housing member 11. The recesses 15*a* communicate with the terminal-receiving grooves 15 and extend toward the center of the body of the housing member 11. The body portions of the terminals 21 are accommodated within the recesses 15*a*. Entrance portions of the terminal-receiving grooves 15 are located closer to the center of the body of the housing member 11 as compared with the end surfaces 13*b* of the end projections 13 and the end surfaces 14*a* of the intermediate projections 14, whereby, as shown in FIG. 6, spaces are provided between the entrance portions of the terminal-receiving grooves 15 and the inner surface of the shell 31 so as to enable movement of connection arm portions (elastic arm members) 23 of the terminals 21.

The terminals 21 are formed through punching and forming a metal plate such that each terminal has a generally U-shaped body having a lower base portion 21*a* and an upper base portion 21*b*. The lower base portion 21*a* and the upper base portion 21*b* are connected together via a curved portion. The curved portion enables the U-shaped body to function as a spring. The lower base portion 21*a* is wider than the upper base portion 21*b*, and has protrusions for biting into the side walls of the corresponding accommodation recess 15*a* of the housing member 11. Further, a tail portion (solder tail) 22 extends from the distal end of the lower base portion 21*a*. A connection arm portion 23 extends from the distal end of the upper base portion 21*b*. The connection arm portion 23 serves as a contact piece to be electrically connected to a signal wiring trace exposed at the bottom surface 56 of the module 53. The connection arm portion 23 extends from the distal end of the upper base portion 21*b* via a bent portion and extends obliquely upward. The free end (upper end) of the connection arm portion 23 is formed in an outwardly bulged shape so as to form a contact portion 23*a*, which comes into contact with the surface of the signal wiring trace of the module 53.

In a state in which the terminal 21 is disposed in the corresponding terminal-receiving groove 15 of the housing member 11, the lower base portion 21*a* is sandwiched from the opposite lateral sides by the opposite side walls of the accommodation recess 15*a*, whereby the lower base portion 21*a* is fixed. In this case, since the protrusions of the lower base portion 21*a* bite into the side walls of the recess 15*a*, the lower base portion 21*a* is reliably fixed. As shown in FIG. 6, the lower surface of the tail portion 22 projects a short distance downward from the lower surface of the housing member 11, and the connection arm portion 23 projects a great distance upward from the upper surface of the housing member 11. The tail portion 22 is connected, by means of solder, for example, to a wiring trace formed on the substrate 51 or a land connected to the wiring trace.

Figure 4:
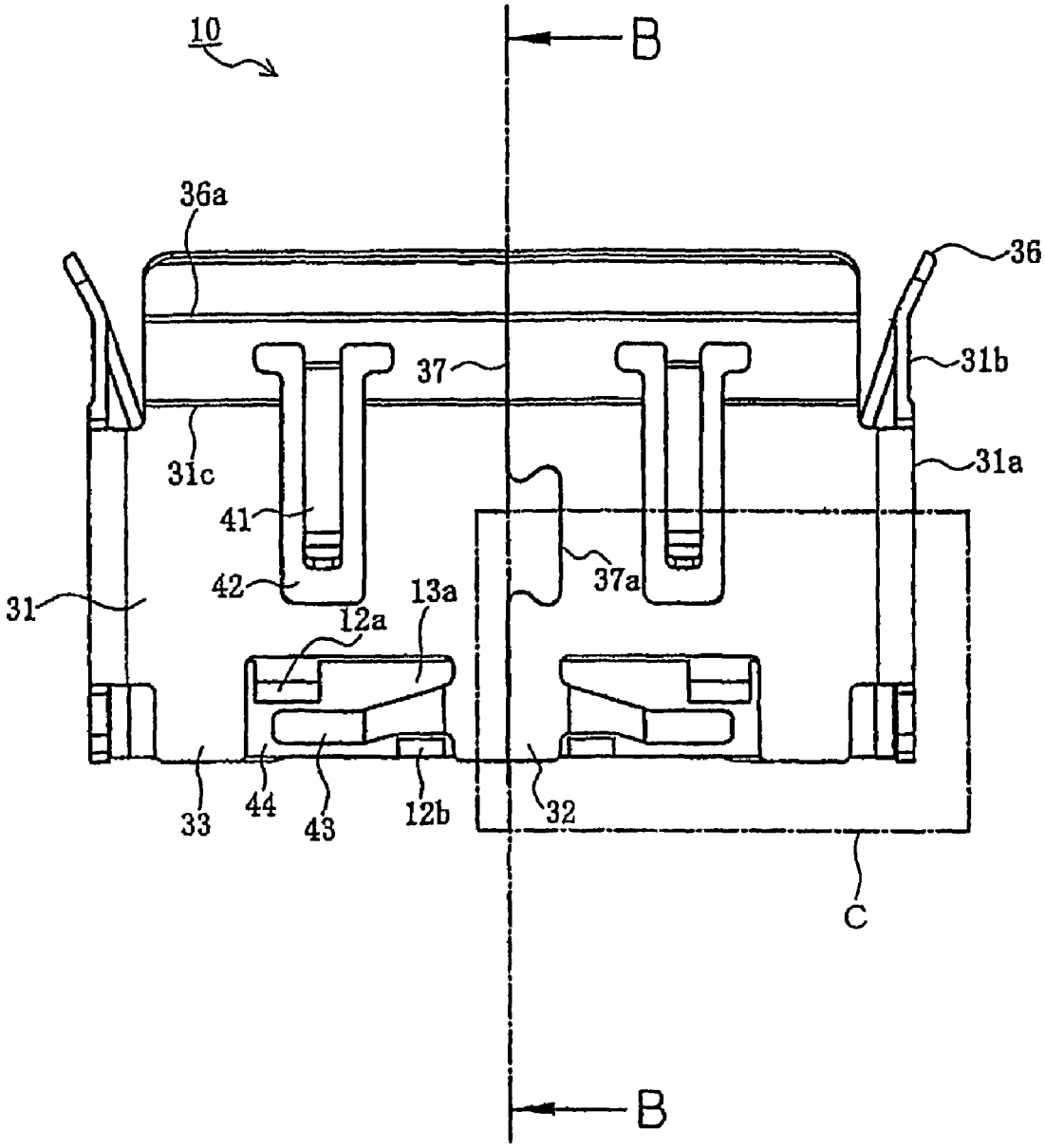
FIG. 4 is a side view of the camera module socket of FIG. 1.

In the present embodiment, the shell 31 is shown as formed from a single metal plate member, and assumes the form of a rectangular tubular body which is formed through a process of bending at right angles the plate member at four bending portions 35*a*, and causing opposite ends of the plate member to engage and be joined together. That is, the shell 31 assumes a shape formed by four rectangular walls connected together such that adjacent walls intersect each other perpendicularly. The shell 31 is connected, at its lower edge, to a circumferential edge of the housing member 11, and serves as a side wall of the socket 10. The four walls of the shell 31 cooperate to define a side wall that surrounds the housing member 11 on all four sides thereof. The shell 31 has a rectangular cross section such that one pair of opposite sides are slightly longer along the substrate than the other pair of opposite sides. In this case, as shown in FIG. 4, a joint portion 37 formed as a result of joining the opposite ends of the plate member is located at a central portion of one side surface of the rectangular tubular body, and extends vertically from the upper end of an inclined portion 36 to the lower end of a connection arm support projection 32. A convexly shaped portion 37*a* is formed at one end of the plate member, and a concavely shaped portion corresponding to the convexly shaped portion 37*a* is formed at the other end of the plate member. The convexly shaped portion 37*a* is engaged with the concavely shaped portion, and the two portions are then subjected to crimping, whereby the convexly shaped portion 37*a* and the concavely shaped portion are mutually tightened, and the joining of the opposite ends at the joint portion 37 is made solid.

A plurality of lower projections project downward from the lower edges of the shell 31 for contacting traces or pads on the circuit board. The lower projections include connection arm support projections 32, wide projections 33, and narrow projections 34. The connection arm support projections 32 and the wide projections 33 are formed at the shorter lower edges corresponding to the shorter sides. The narrow projections 34 are formed at the longer lower edges corresponding to the longer sides. The narrow projections 34 are such that four narrow projections 34 are formed at a predetermined pitch at each of the longer lower edges. The connection arm support projections 32 are formed at the centers of the shorter lower edges, and the wide projections 33 are formed on the opposite sides of each connection arm support projection 32. The above-described joint portion 37 is located at the center of the connection arm support projection 32. An engagement opening portion 44 is formed between the connection arm support projection 32 and each of the wide projections 33. The engagement arms 43 project from the opposite lateral edges of each connection arm support projection 32 toward the corresponding wide projections 33, and extend horizontally within the corresponding engagement opening portions 44. Each of the engagement arms 43 is a cantilever member formed integrally with the shell 31. Proximal end portions of the engagement arms 43 are connected to the opposite lateral edges of the connection arm support projection 32, and distal end portions of the engagement arms 43 are free ends. These arms 43 preferably press against the sides of the housing member 11.

Figure 7:
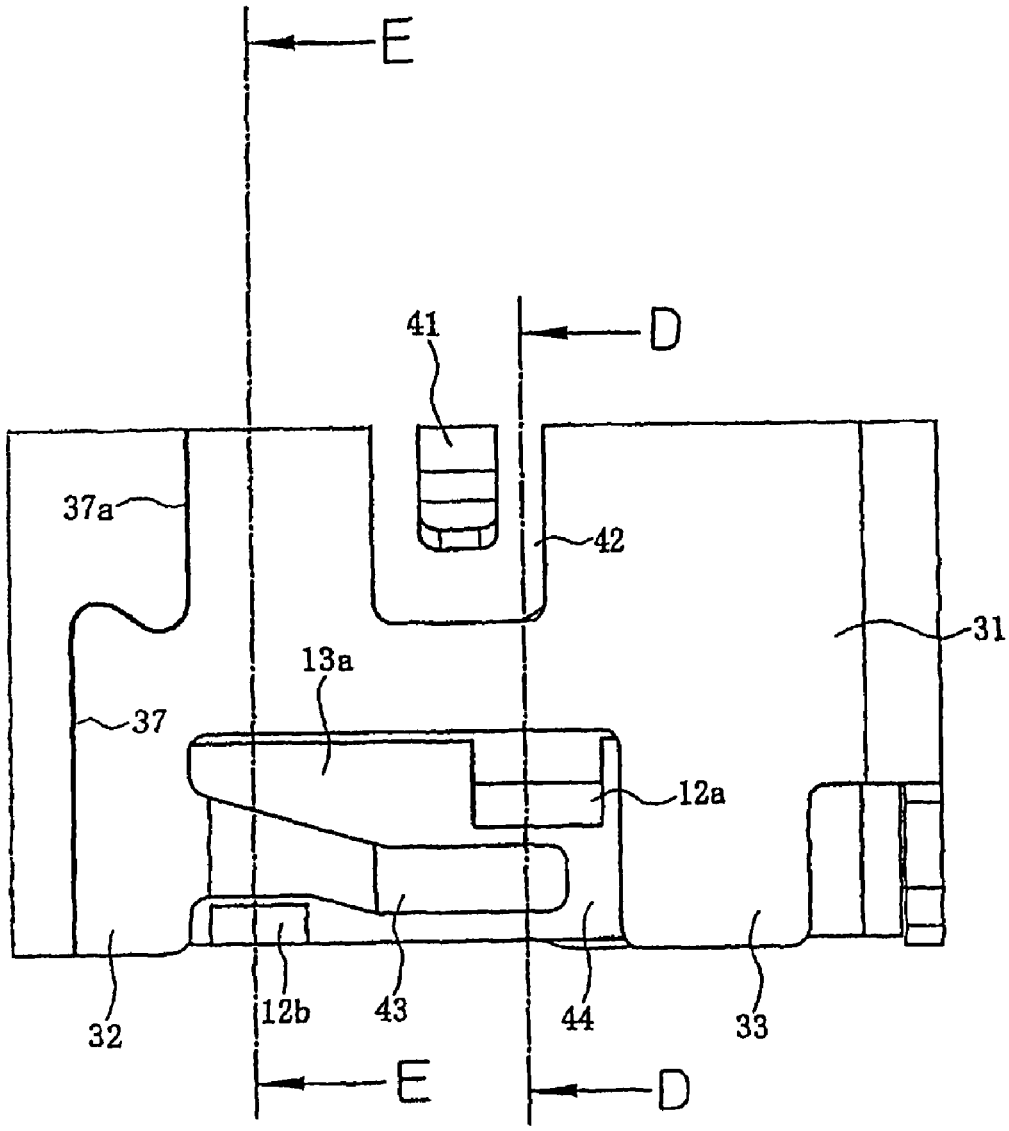
FIG. 7 is an enlarged detail view of a portion of the camera module socket at area C in FIG. 4.
Figure 8:
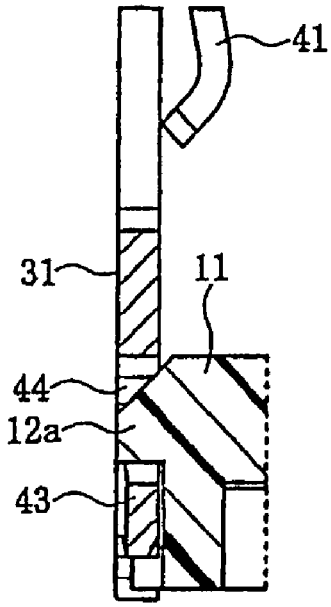
FIG. 8 is an enlarged partial sectional view of the camera module socket taken along line D-D of FIG. 7.
Figure 9:
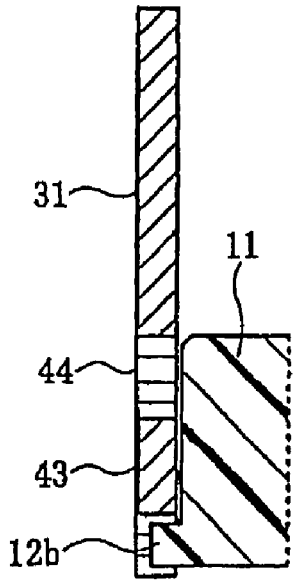
FIG. 9 is an enlarged partial sectional view of the camera module socket taken along line E-E of FIG. 7.

In a state in which the shell 31 is attached to the housing member 11, as shown in FIGS. 4 and 7, the upper and lower engagement projections 12*a* and 12*b* are located within the corresponding engagement openings 44. The upper engagement projection 12*a* is located above the corresponding engagement arm 43 in the vicinity of the distal end of the engagement arm 43. The lower engagement projection 12*b* is located below the corresponding engagement arm 43 in the vicinity of the proximal end of the engagement arm 43. As shown in FIG. 8, the tip end (left end in FIG. 8) of the upper engagement projection 12*a* enters the corresponding engagement opening 44, and the lower end of the upper engagement projection 12*a* comes into engagement with the upper end of the corresponding engagement arm 43 in the vicinity of the distal end thereof, to thereby restrict or limit upward movement of the shell 31 with respect to the housing member 11. Further, as shown in FIG. 9, the tip end (left end in FIG. 9) of the lower engagement projection 12*b* enters the corresponding engagement opening 44, and the upper end of the lower engagement projection 12*b* comes into engagement with lower end of the corresponding engagement arm 43 in the vicinity of the proximal end thereof so as to restrict or limit downward movement of the shell 31 with respect to the housing member 11. Notably, in FIGS. 4 and 7, a clearance is formed between the lower end of the upper engagement projection 12*a* and the upper end of the engagement arm 43 in the vicinity of the distal end thereof, and a clearance is formed between the upper end of the lower engagement projection 12*b* and the lower end of the engagement arm 43 in the vicinity of the proximal end thereof. The shell 31 can move vertically with respect to the housing member 11 by the total distance of these clearances.

When the shell 31 is attached to the housing member 11, the lower edges of the shell 31 surround the entire circumference of the housing member 1. As shown in FIGS. 3 to 6, as in the case of the lower surfaces of the tail portions 22 of the terminals 21, the lower end surfaces of the connection arm support projections 32, the wide projections 33, and the narrow projections 34 project a short distance downward from the lower surface of the housing member 11. In the present embodiment, in the state in which the shell 31 is attached to the housing member 11, the shell 31 can be moved with respect to the housing member 11 in the vertical direction; i.e., the height direction. The movable range, i.e., a predetermined distance over which the shell 31 is movable, is restricted by means of engagement between the engagement arms 43 and the upper and lower engagement projections 12*a* and 12*b*. Thus, the vertical positions of the connection arm support projections 32, the wide projections 33, and the narrow projections 34, as well as the vertical positions of the lower surfaces of the tail portions 22 of the terminals 21, are automatically adjusted individually. Therefore, the connection arm support projections 32, the wide projections 33, and the narrow projections 34, as well as the tail portions 22 of the terminals 21, can be reliably connected, by means of soldering or a like process, to wiring traces formed on the substrate 51 or connection pads connected to the wiring traces. Notably, at least some of the wiring traces or connection pads are connected to a ground wiring trace of the substrate 51. Thus, the shell 31 is grounded, and functions as an electromagnetic shield. The numbers and pitches of the connection arm support projections 32, the wide projections 33, and the narrow projections 34 can be freely changed so long as these projections do not interfere with signal wiring traces formed on the substrate 51.

The body of the shell 31 preferably includes a thick wall portion 31*a* having a relatively large thickness and a thin wall portion 31*b* having a relatively small thickness. In this case, in view of strength of the shell 31, the thin wall portion 31*b* preferably extends over only a limited range; i.e., over a predetermined distance from the upper end of the shell 31. Reference numeral 31*c* denotes a border between the thick wall portion 31*a* and the thin wall portion 31*b*. An upper end portion of the shell 31 is bent at a bending portion 36*a* so as to form the inclined portion or lip 36, which inclines outward. Notably, the inclined portion 36 is a portion of the thin wall portion 31*b*. The inclined portion 36 increases the cross sectional area of the shell 31 at the upper end such that the cross sectional area gradually increases upward. Therefore, at the time of mounting the module 53, a task for inserting the module 53 into the shell 31 from above can be easily performed. Moreover, cutaway portions 35 are formed at positions corresponding to the bending portions 35*a*, so that the thin wall portion 31*b* is divided into four sections which correspond to the four walls and which are independent of one another.

As shown in FIGS. 1 and 6, a vertically extending engagement slot 47 is formed in the wall of the shell 31 in which the connection arm support projection 32 is formed and which does not include the joint portion 37. A polarity key 58 (a projection indicating the orientation or polarity of the module 53) is formed on one side surface of the module 53 such that the polarity key 58 projects outward. At the time of mounting the module 53, the module 53 is inserted into the shell 31 from above in an orientation such that the polarity key 58 is fitted into the engagement slot 47. Thus, the module 53 is attached to the socket 10 in a predetermined orientation, and the signal wiring traces exposed at the bottom surface 56 of the module 53 are connected to the connection arm portions 23 of the corresponding terminals 21.

Figure 5:
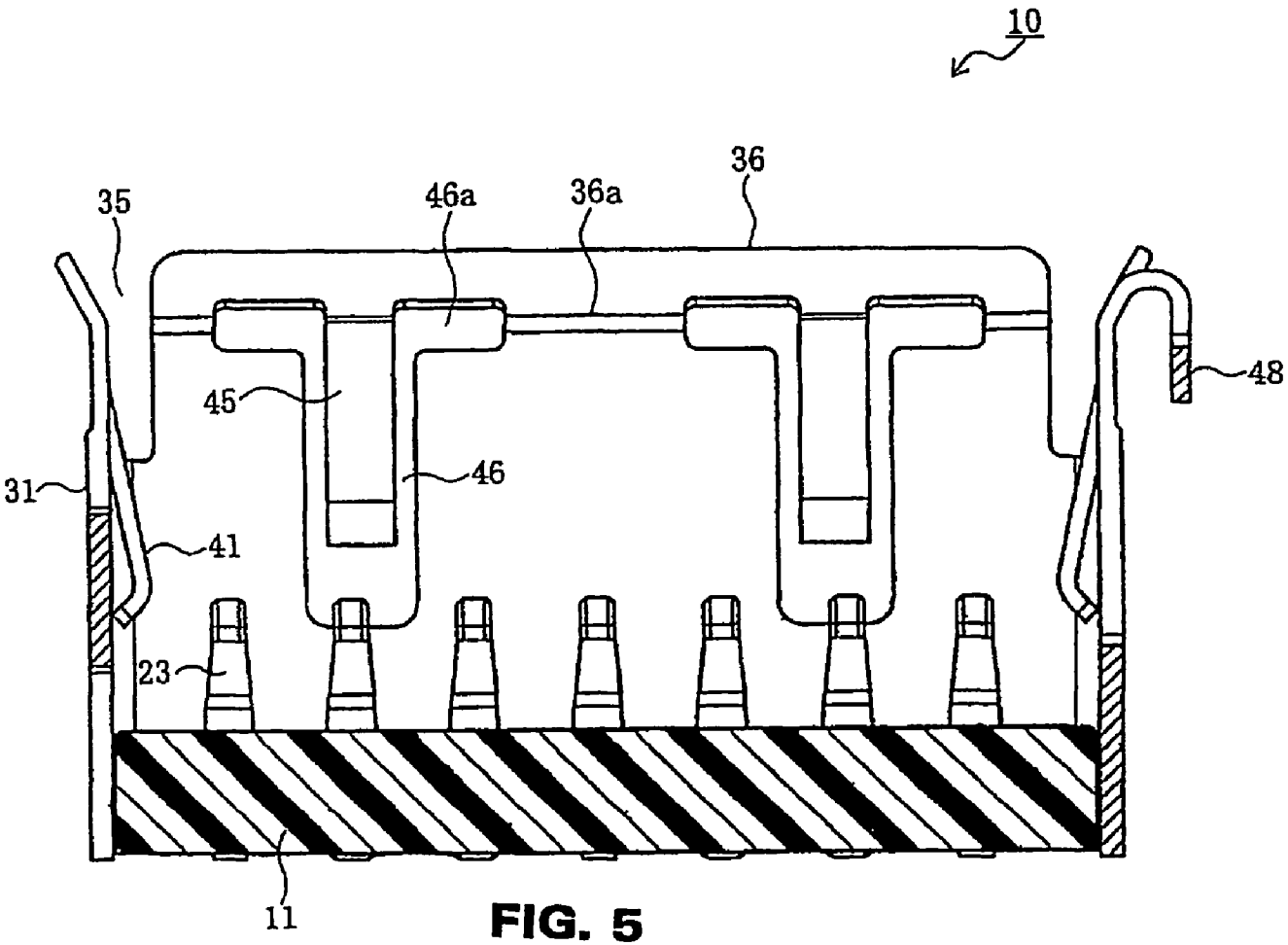
FIG. 5 is a sectional view of the camera module socket taken along line B-B of FIG. 4.

The upper end of the engagement slot 47 is surrounded by a bridge portion 48, which is formed integrally with the inclined portion 36 such that the bridge portion 48 projects from the upper edge of the inclined portion 36. Since the bridge portion 48 connects portions of the inclined portion 36 located on the opposite sides of the engagement slot 47, the strength of the wall of the shell 31 in which the engagement slot 47 is formed is increased, and deformation of the wall can be prevented. As shown in FIG. 5, the bridge portion 48 extends from the inclined portion 36, while being bent at an angle of about 180 degrees, so that its distal end extends vertically. Therefore, as shown in FIGS. 1 and 6, in the vicinity of the upper end, the engagement slot 47 is opened upward. Therefore, at the time of mounting the module 53, a task for inserting the polarity key 58 of the module 53 into the engagement slot 47 from above can be easily performed.

Moreover, two grounding spring portions (elastic contact pieces) 41 are formed on each of the walls of the shell 31 on which the connection arm support projections 32 are formed. The grounding spring portions 41 come into contact with the side surface 55 of the module 53 mounted to the socket 10, and are electrically connected to a metal coating layer formed on the side surface 55. The metal coating layer of the module 53 functions as an electromagnetic shield. Upon contact with the grounding spring portions 41, the metal coating layer is electrically connected to the ground wiring trace of the substrate 51 via the shell 31. Notably, the number and positions of the grounding spring portions 41 can be determined freely. Since the grounding spring portions 41 are formed by removing a portion of the shell 31 by means of punching or other suitable machining method, an opening 42 is formed around each of the grounding spring portions 41.

Meanwhile, two locking spring portions (elastic engagement pieces) 45 are formed on each of the walls of the shell 31 on which the connection arm support projections 32 are not formed. The locking spring portions 45 come into engagement with engagement recesses 57 to be described later, which are formed on the side surface 55 of the module 53 mounted to the socket 10, so as to lock the module 53. As in the case of the grounding spring portions 41, since the locking spring portions 45 are formed by removing a portion of the shell 31, by means of punching or other suitable machining method, an opening 46 is formed around each of the locking spring portions 45. Notably, in the case where the metal coating layer of the module 53 is formed within the engagement recesses 57, the locking spring portions 45 servo as grounding spring portions in the same manner as the grounding spring portions 41. In order to disengage the grounding and locking spring portions 41, 45, a user can press the inclined portion or lip 36 to cam the portions 41, 45 away from the module.

Figure 10:
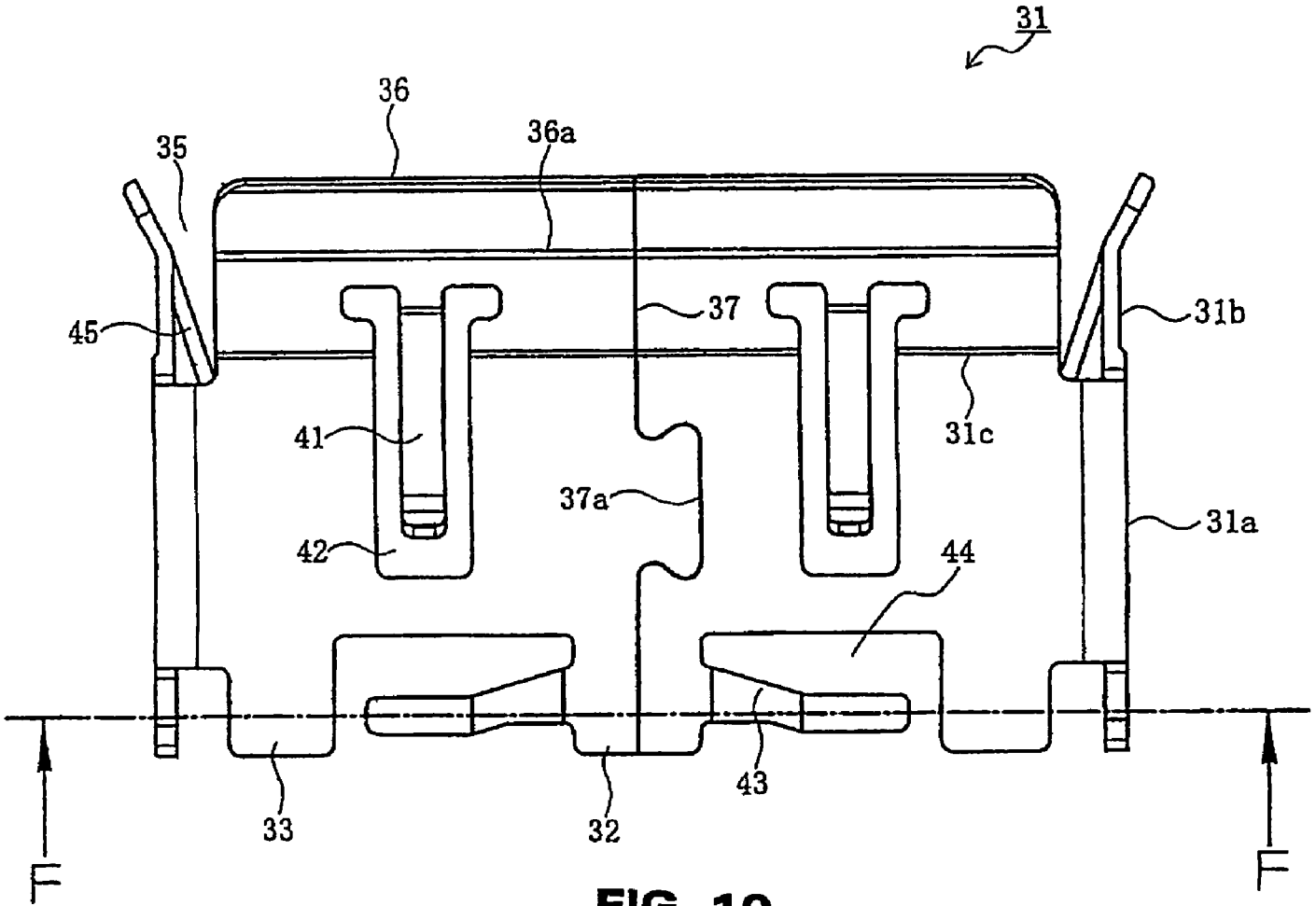
FIG. 10 is a side view of the shell of the camera module socket of FIG. 1.

FIG. 10 is a side view of the shell and as shown therein, the grounding spring portions 41 and the locking spring portions 45 projects inward from the inner wall surfaces of the side walls of the shell 31. As shown in FIGS. 1 and 4 to 6, the grounding spring portions 41 and the locking spring portions 45 are elongated tongue-shaped members whose upper ends are connected to the thin wall portion 31 b of the body of the shell 31 and which extend obliquely downward. The lower ends of the grounding spring portions 41 and the locking spring portions 45 are free ends. As shown in FIGS. 5 and 6, distal end portions of the grounding spring portions 41 and the locking spring portions 45 are curved outward, and the curved portions project inward to the greatest extent. Therefore, when the module 53 is mounted, the curved surfaces of the curved portions of the grounding spring portions 41 and the locking spring portions 45 come into contact with the side surface 55 of the module 53. Therefore, even when the side surface 55 of the module 53 moves in contact with the curved portions, the side surface 55 receives no resistance, and can move smoothly.

Figure 11:
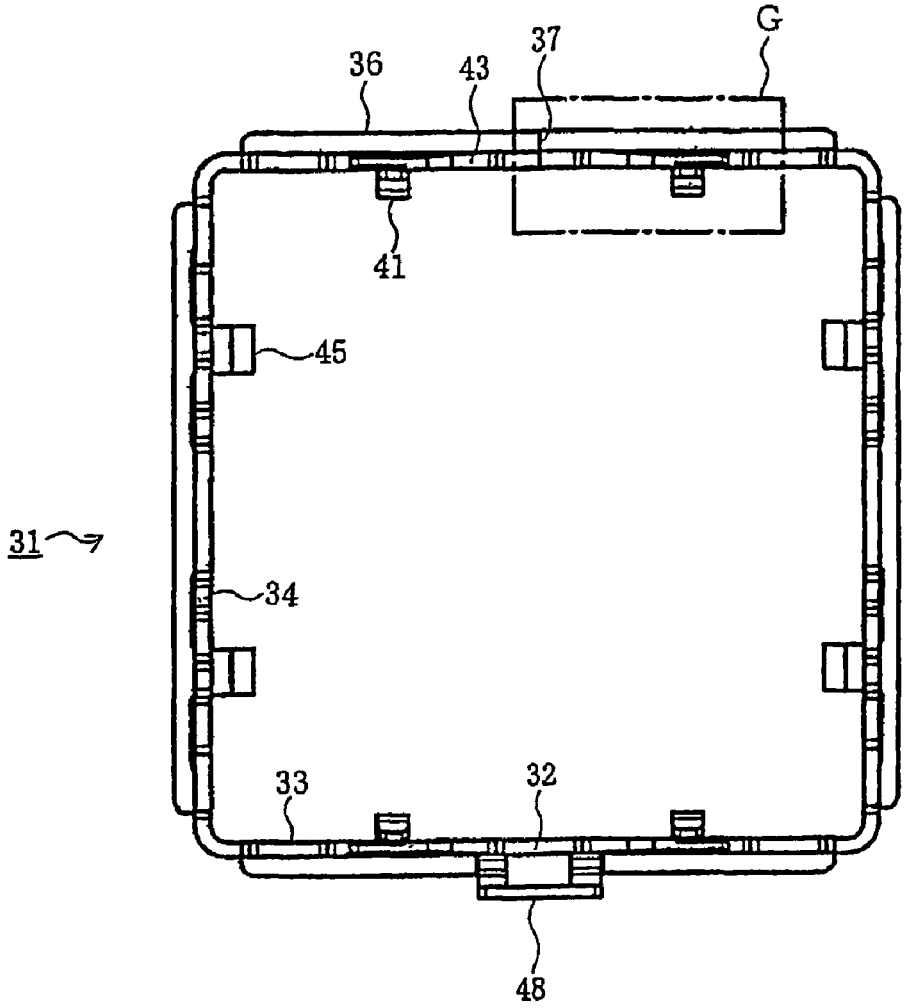
FIG. 11 is a bottom view of the shell of FIG. 10.

As shown in FIG. 6, the lower end of each locking spring portion 45 is curved greatly and generally extends horizontally, so that the bent angle at the curved portion is an acute angle. Thus, the curved portion of each locking spring portion 45 fits the inner surface of the engagement recess 57 formed on the side surface 55 of the module 53, whereby the curved portion of each locking spring portion 45 reliably engages with the engagement recess 57, and hardly comes off. Further, as shown in FIGS. 5, 6, and 11, the amount of inward projection of the curved portion of each locking spring portion 45 is greater than the amount of inward projection of the curved portion of each grounding spring portion 41, because the curved portion of each grounding spring portion 41 comes into contact with the side surface 55 of the module 53 attached to the socket 10, whereas the curved portion of each locking spring portion 45 comes into engagement with the engagement recess 57 formed on the side surface 55 of the module 53.

Incidentally, when the module 53 is mounted, the curved portion (free end) of each locking spring portion 45 is pushed outward by the side surface 55 of the module 53 to a position near the inner wall surface of the shell 31, and enters the engagement recess 57 of the module 53 after completion of the mounting of the module 53. Therefore, the curved portion moves within a wide moving range, and over the entire moving range, the curved portion is required to be urged toward the side surface 55 of the module 53 or the side surface of the engagement recess 57. That is, over the entire moving range of the curved portion, the locking spring portion 45 is required to function as a spring.

Figure 3:
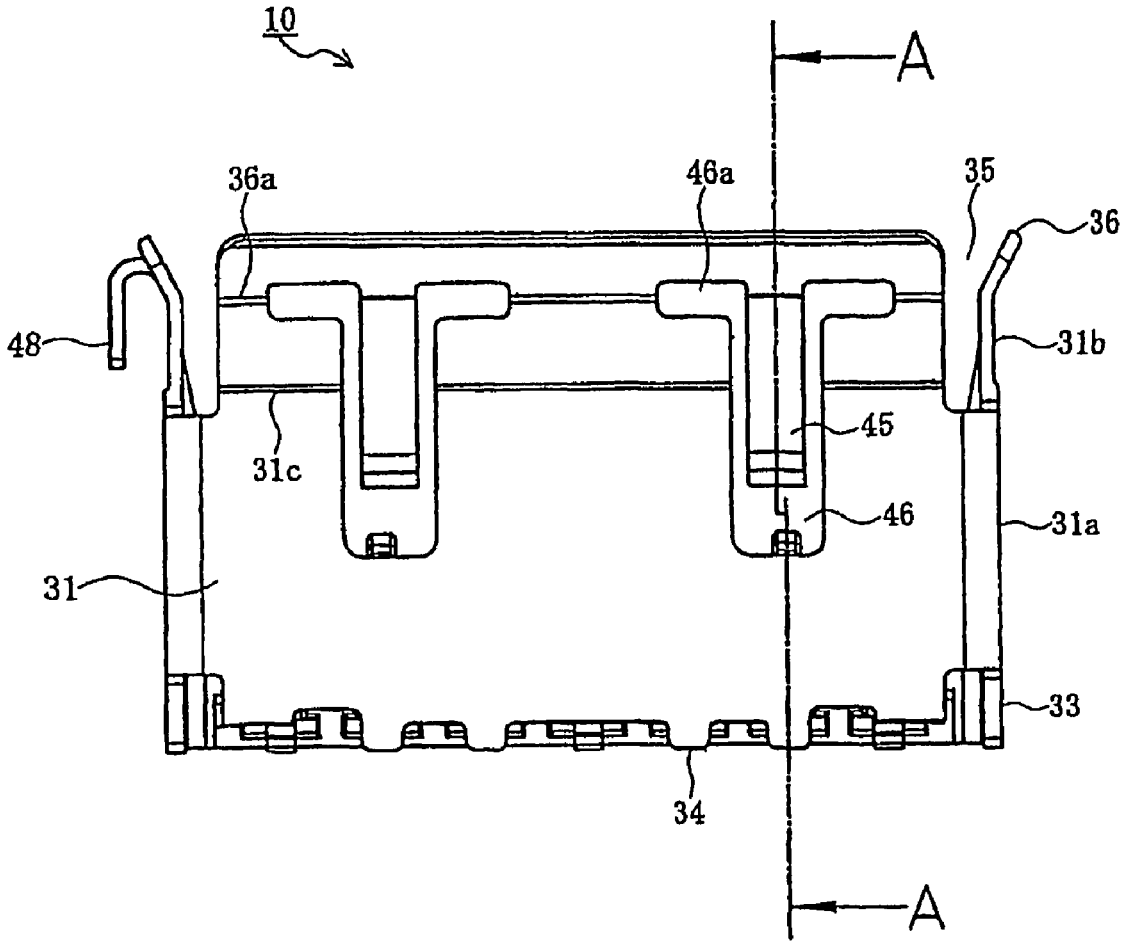
FIG. 3 is a front view of the camera module socket of FIG. 1.

Therefore, the locking spring portions 45 and the openings 46 have respective shapes as shown in FIGS. 3 and 5. Each of the openings 46 has a wide portion 46*a* at a location where the locking spring portion 45 is connected to the thin wall portion 31*b* of the shell 31. The width portion 46*a* extends in the lateral direction. In order to widen the moving range of the curved portion of each locking spring portion 45 in which the locking spring portion 45 provides a spring function, the distance between a point at which the locking spring portion 45 is connected to the thin wall portion 31*b* and the free end of the locking spring portion 45; i.e., the length of the locking spring portion 45 is desired to be increased. However, sufficiently increasing the length of the locking spring portion 45 is difficult because of restrictive factors such as the vertical dimension of the shell 31, and the position of the engagement recesses 57 of the module 53.

The distance between the opposite ends of the wide portion 46*a* is increased to a possible extent, and the distance between the upper edge of the wide portion 46*a* and the upper edge of the inclined portion 36 is decreased to a possible extent. Thus, the area sandwiched between the upper edge of the wide portion 46*a* and the upper edge of the inclined portion 36 assumes an elongated rectangular shape, and functions as a torsion spring. That is, since the area is located in the thin wall portion 31*b* having a small wall thickness, even when the force received from the corresponding locking spring portion 45 is relatively weak, the area undergoes torsional deformation, and thus, functions as a torsion spring. This configuration widens the moving range of the curved portion of each locking spring portion 45 in which the locking spring portion 45 provides a spring function. The distance between the upper edge of the wide portion 46*a* and the upper edge of the inclined portion 36 can be freely determined such that the above-described area can function as a torsion spring.

Meanwhile, the curved portion (free end) of each grounding spring portion 41 is not required to move over a large distance when the module 53 is mounted. Therefore, the moving range of the curved portion of each grounding spring portion 41 in which the grounding spring portion 41 provides a spring function may be shorter than that of each locking spring portion 45. Therefore, an area which functions as a torsion spring is not required. Therefore, as shown in FIGS. 4 and 6, a location where the grounding spring portion 41 is connected to the thin wall portion 31*b* of the shell 31 is away from the upper edge of the inclined portion 36 by a relatively large distance. Notably, as in the case of the locking spring portions 45, for which the wide portions 46*a* are provided, wide portions may be formed in the openings 42 for the grounding spring portions 41.

Figure 12:
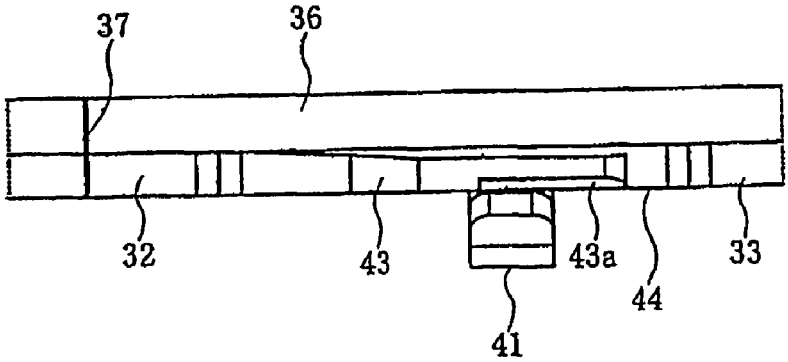
FIG. 12 is an enlarged partial view of a portion of the shell corresponding to area G in FIG. 11 and illustrating the third engagement arm.
Figure 13:
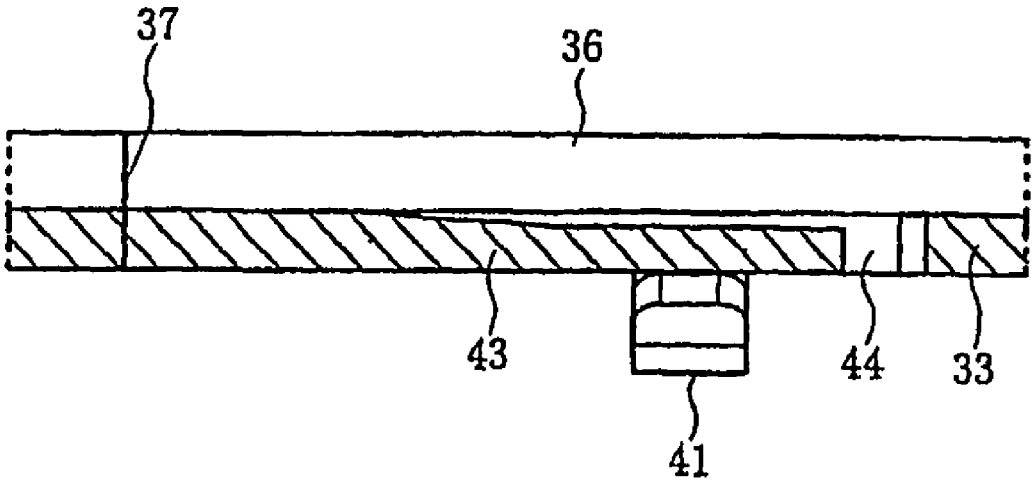
FIG. 13 is an enlarged partial view of a portion of the shell corresponding to an area in a cross section taken along line F-F of FIG. 10 and of area G in FIG. 11.

Moreover, as shown in FIGS. 12 and 13, each engagement arm 43 is a plate-shaped portion, whose proximal end portion has a thickness similar to that of the connection arm support projection 32, and whose distal end portion is thinner than the proximal end portion. This configuration enables the engagement arm 43 to function as a plate spring, especially, in the vicinity of the distal end portion. Therefore, when the shell 31 is mounted to the housing member 11, the distal end portion of each engagement arm 43 is caused to elastically curve toward the outside (upper side in FIGS. 12 and 13) of the shell 31, and easily pass over the corresponding upper engagement projection 12*a*. Notably, an inclined surface or taper surface 43*a* is formed on the lower end of the distal end portion (and the vicinity thereof) of each engagement arm 43 at the inner edge thereof (the lower edge in FIGS. 12 and 13). When the shell 31 is mounted to the housing member 11, the taper surface 43*a* comes into engagement with the taper surface formed on the upper end of the corresponding tipper engagement projection 12*a*. Therefore, the sliding movement between the lower end of each engagement arm 43 and the upper end of the corresponding upper engagement projection 12*a* becomes smooth, and the distal end portion of each engagement arm 43 can easily pass over the upper engagement projection 12*a*.

Accordingly, during a task for assembling the shell 31 and the housing member 11 together, strong external force does not act on the shell 31 and the housing member 11. Therefore, the shell 31 and the housing member 11 are neither deformed nor damaged. In addition, a task for assembling the shell 31 and the housing member 11 together can be performed easily and accurately.

Figure 14:
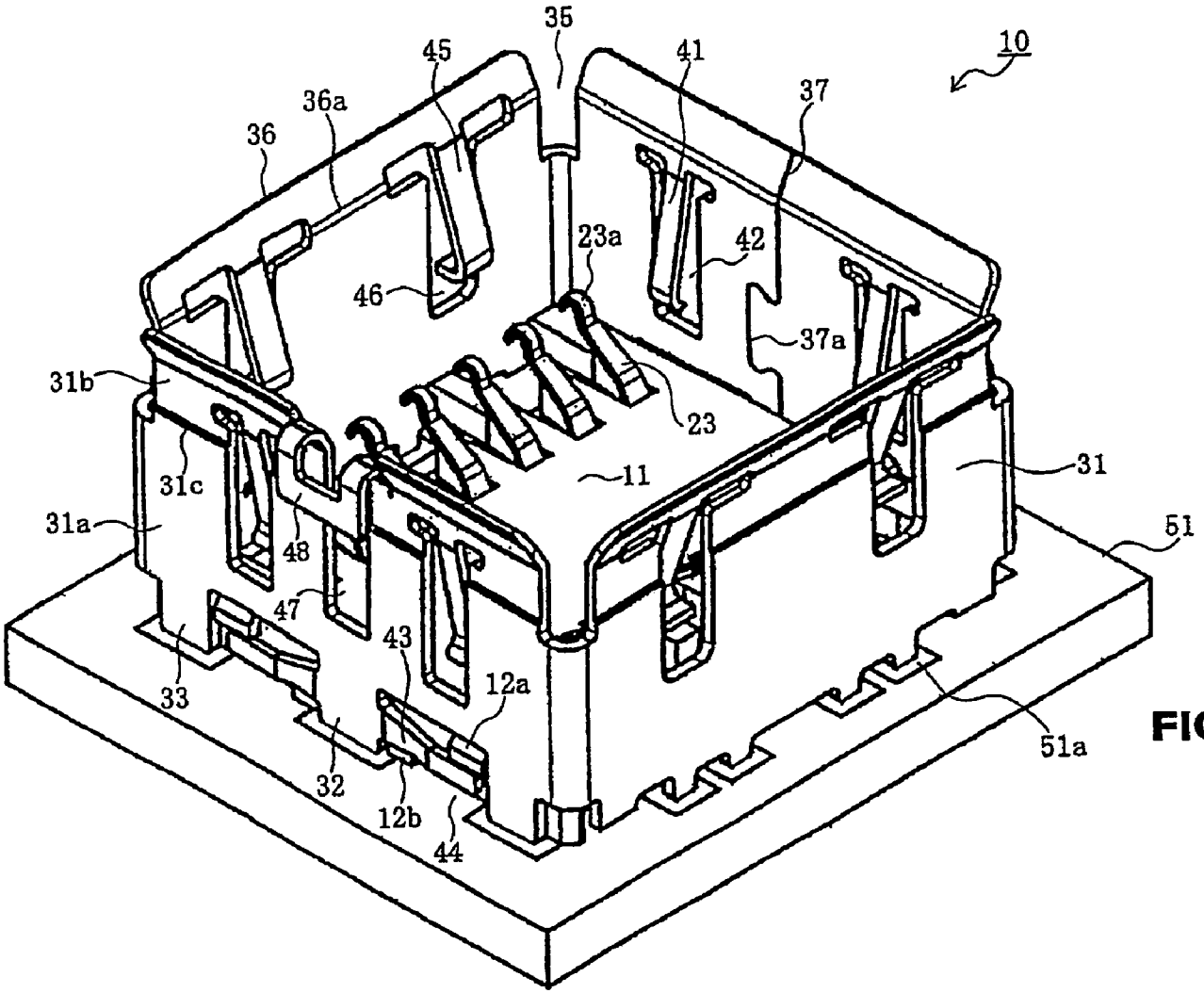
FIG. 14 is a perspective view of the camera module socket shown mounted to a substrate.
Figure 15:
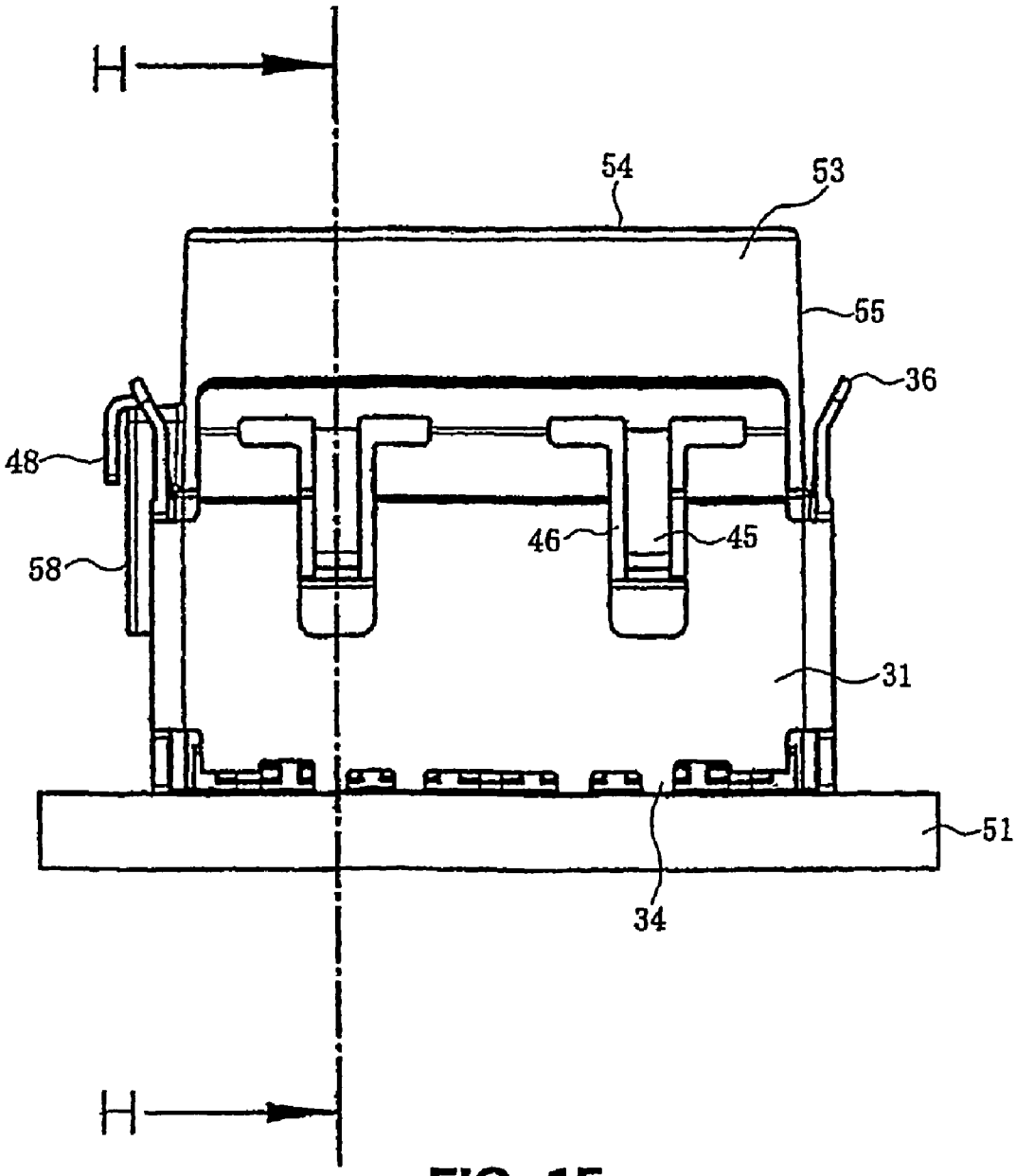
FIG. 15 is a front elevational view of the mounted camera module socket of FIG. 14.

As shown in FIG. 14, the socket 10 is previously mounted on the substrate 51. The substrate 51 has wiring traces for signals, and the wiring traces are exposed at the upper surface and form connection portions at least at a location where the socket 10 is mounted, or are connected to connection portions such as connection pads exposed at the upper surface. The terminals 21 of the socket 10 can be connected to the connection portions by use of connection means such as soldering. Specifically, the lower surfaces of the tail portions 22 of the terminal 21 are connected to the connection portions by use of connection means such as soldering. Further, the substrate 51 has wiring traces for grounding, and the wiring traces are exposed at the upper surface and form grounding connection portions 51*a* at least at a location where the socket 10 is mounted, or are connected to grounding connection portions 51*a* such as connection pads exposed at the upper surface. The connection arm support projections 32, the wide projections 33, and the narrow projections 34 of the socket 10 can be connected to the grounding connection portions 51*a* by use of connection means such as soldering. Specifically, the lower end surfaces of the connection arm support projections 32, the wide projections 33, and the narrow projections 34 are connected to the grounding connection portions 51*a* by use of connection means such as soldering.

For example, in the case where the socket 10 is mounted to the substrate 51 by using soldering as a connection means, solder in the form of paste is applied to the upper surfaces of the connection portions and the grounding connection portions 51*a* exposed at the upper surface of the substrate 51, and is subjected to reflow, whereby soldering is performed. In this case, the socket 10 is placed on the substrate 51 in such a manner that the tail portions 22 of the corresponding terminals 21, the connection arm support projections 32, the wide projections 33, and the narrow projections 34 are located on the connection portions and the grounding connection portions 51 a, to which soldering has been applied. In a state in which the socket 10 is placed on the substrate 51, the solder is heated by use of heating means such as a heating furnace and is caused to reflow, whereby soldering is performed. In the socket 10 according to the present embodiment, as described above, the shell 31 can move vertically with respect to the housing member 11 by a predetermined distance. Thus, when the socket 10 is placed on the substrate 51, the vertical positions of the lower surfaces of the tail portions 22 of the terminals 21, as well as the vertical positions of the lower end surfaces of the connection arm support projections 32, the wide projections 33, and the narrow projections 34, are automatically adjusted individually. Therefore, even when the solder applied to the connection portions and the grounding connection portions 51*a* exposed at the upper surface of the substrate 51 is thin (e.g., approximately 0.1 mm), the lower surfaces of the tail portions 22 of all the terminals 21, as well as the lower end surfaces of the vertical positions of the connection arm support projections 32, the wide projections 33, and the narrow projections 34, reliably come into contact with the solder applied to the corresponding connection portions and the grounding connection portions 51*a*, whereby the lower surface and lower end surfaces are reliably soldered to the corresponding connection portions and the grounding connection portions 51*a*.

Notably, before mounting of the module 53, as shown in FIG. 14, the free ends of the connection arm portions 23 of the terminals 21 greatly project upward from the upper surface of the housing member 11. Further, the curved portions of the grinding spring portions 41 and the locking spring portions 45 greatly project inward from the inner wall surface of the shell 31. The module 53 is inserted into the shell 31 from the above, and thus is mounted to the socket 10, as shown in FIGS. 15 to 18. The module 53 has the upper surface 54, the side surface 55, and the bottom surface 56, and a metal coating layer is formed on the upper surface 54 and the side surface 55 by means of, for example, plating. Further, predetermined signal wiring traces are exposed at the bottom surface 56 and are connected to the connection arm portions 23 of the corresponding terminals 21.

Since the inclined portion 36 is formed at the upper end of the shell 31 to thereby increase the cross sectional area of the shell 31 upward at the upper end thereof, the module 53 can be easily inserted into the shell 31. Further, an unillustrated polarity key 58 is formed on the side surface 55 of the module 53 such that its projects outward. Therefore, the module 53 is inserted into the shell 31 from above in such a manner that the polarity key 58 is fitted into the engagement slot 47 of the shell 31. Notably, since the upper end portion of the engagement slot 47 is opened upward, the polarity key 58 of the module 53 can be easily inserted into the engagement slot 47 from the above. In this manner, the module 53 is attached to the socket 10 in a predetermined orientation, and the predetermined signal wiring traces exposed at the bottom surface 56 of the module 53 are connected to the connection arm portions 23 of the corresponding terminals 21.

When the module 53 is inserted into the shell 31, the side surface 55 of the module 53 moves while being contact with the curved portions of the grounding spring portions 41 and the locking spring portions 45. In this case, the curved portions are pushed outward by the side surface 55 of the module 53 to positions near the inner wall surface of the shell 31. When the state shown in FIGS. 15 to 18 is established after completion of the mounting of the module 53, the covered portions (free ends) of the locking spring portions 45 enter the engagement recesses 57 of the module 53 and come into engagement with the engagement recesses 57. Notably, the curved portions of the grounding spring portions 41 are pressed by the side surface 55 of the module 53. In this case, by virtue of the spring function of each grounding spring portion 41, electrical connection is secured between the curved portions and the metal coating layer formed on the side surface 55.

Figure 16:
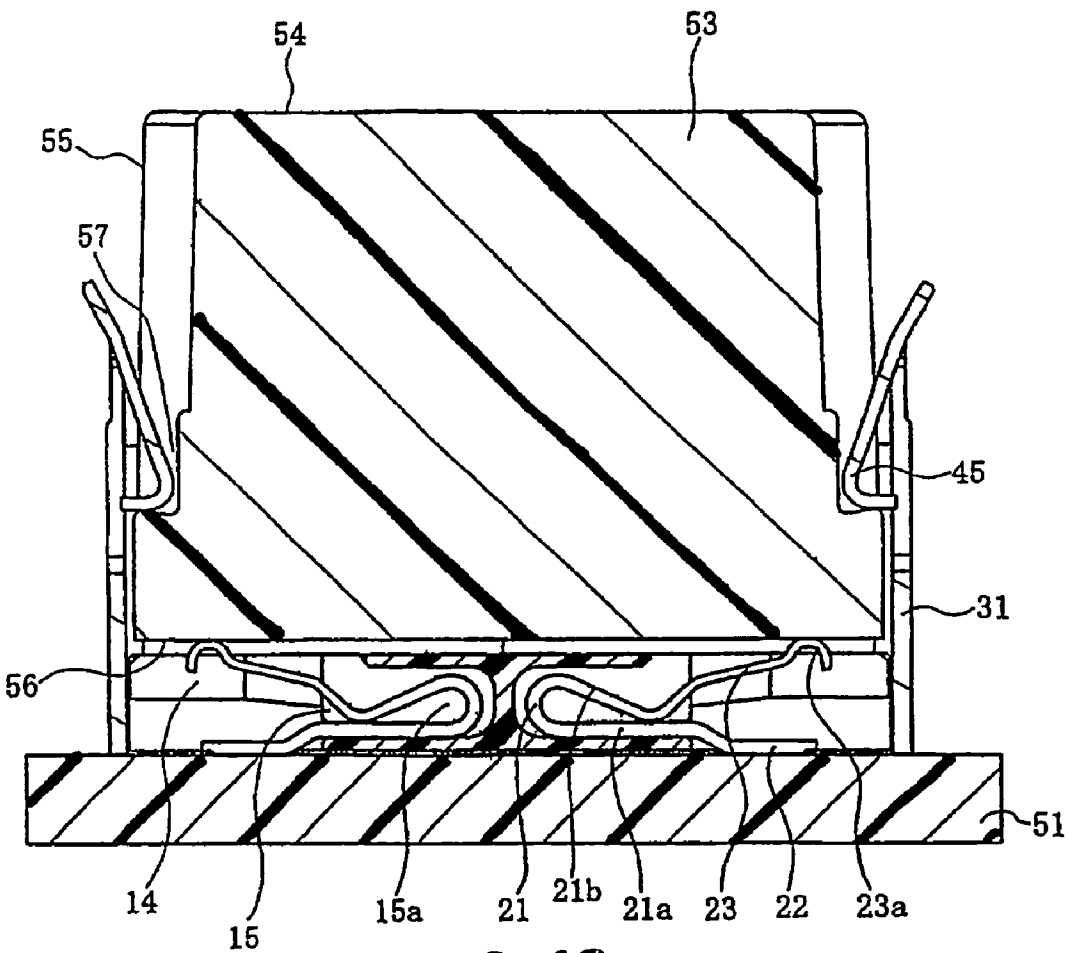
FIG. 16 is a first sectional view of the mounted camera module socket taken along line H-H of FIG. 15.
Figure 17:
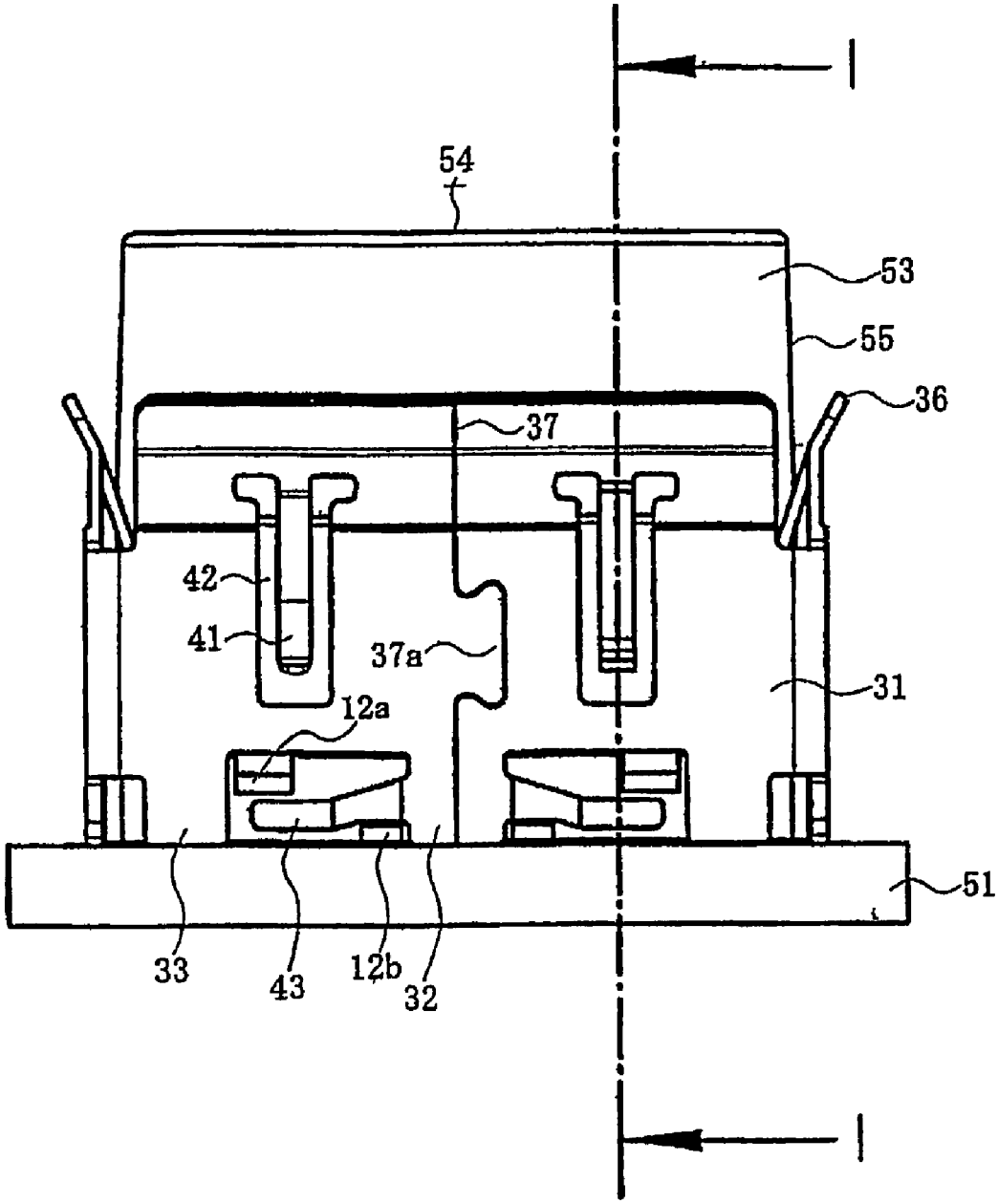
FIG. 17 is a side elevational view of the mounted camera module socket of FIG. 14; and, FIG. 18 is a second sectional view of the camera module socket taken along line I-I of FIG. 17.
Figure 18:
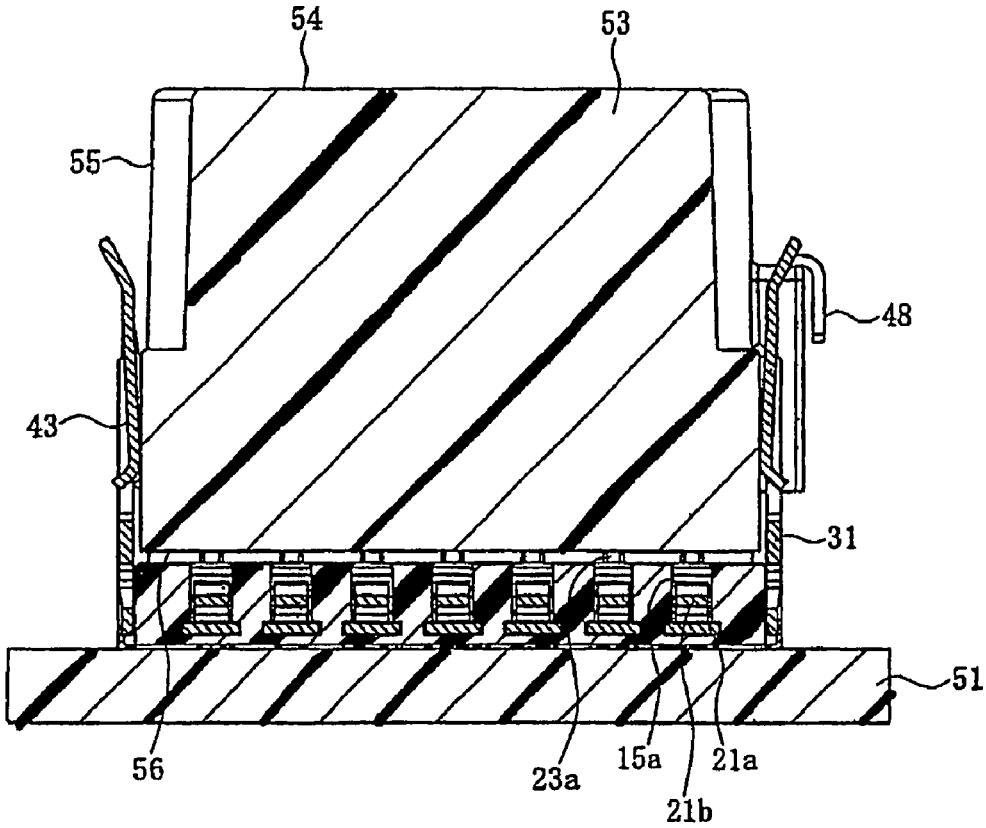

In a state in which the module 53 has been mounted, since the terminals 21 are pressed by the bottom surface 56 of the module 53, the terminals 21 elastically deform into a shape as shown in FIG. 16. Therefore, by virtue of the spring function of each terminal 21, electrical connection is secured between the contact portions 23*a* of the connection arm portions 23 and the signal wiring traces on the bottom surface 56 of the module 53. Moreover, although the module 53 receives an upward pushing force because of the spring function of each terminal 21, upward movement of the module 53 is restricted because the curved portions of the locking spring portions 45 are in engagement with the engagement recesses 57. In this manner, the module 53 is elastically held while being sandwiched from the upper and lower sides thereof by the terminals 21 and the locking spring portions 45. Therefore, the module 53 does not play in the vertical direction.

Moreover, since the module 53 is elastically held while being sandwiched from the four sides thereof by the spring functions of the locking spring portions 45 and the grounding spring portions 41. Therefore, the module 53 does not play in the lateral or horizontal direction.

As described above, the socket 10 according to the present embodiment includes the housing member 11, which is formed of an insulating material and has no side wall, and the shell 31, which is formed from a single metal plate and is attached to the housing member 11 so as to surround at least a portion of the side wall 55 of the module 53 over the entire circumference, to thereby elastically hold the accommodated module 53.

Since a cover for preventing the module 53 from coming off becomes unnecessary, the number of parts can be reduced, and the number of steps of mounting the module 53 decreases, whereby mounting costs can be reduced. Further, a side wall formed of an insulating material is not provided, and the module 53 is surrounded by the shell 31 formed from a metal plate. Therefore, the external dimensions of the socket 10 can be reduced, and the occupying area on the substrate 51 can be reduced. Moreover, since the shell 31 is formed from a single metal plate, and is not composed of a plurality of members, it is possible to prevent deterioration in the dimensional accuracy of the shell 31, which deterioration would otherwise occur due to an unavoidable dimensional error produced at the time of assembly.

Further, the shell 31 is attached to the housing member 11 to be movable in the height direction with respect to the housing member 11. This provides freedom to the vertical positional relationship between the tail portions 22 of the terminals 21 and the connection arm support projections 32, the wide projections 33, and the narrow projections 34. Thus, the tail portions 22 of the terminals 21, the connection arm support projections 32, the wide projections 33, and the narrow projections 34 can be reliably connected to the connection portions and the grounding connection portions 51*a* of the substrate 51. Therefore, the signal wiring traces on the bottom surface 56 of the module 53 are reliably connected to the corresponding connection portions of the substrate 51, so that the module 53 operates properly. Moreover, since the connection arm support projections 32, the wide projections 33, and the narrow projections 34 are reliably connected to the corresponding grounding connection portions 51*a* of the substrate 51, the shell 31 is reliably grounded and properly functions against static electricity and noise, whereby influences of static electricity and noise can be eliminated completely.

What is claimed is:

1. A module socket for receiving a module, comprising:

a bottom member formed of an insulating material and facing a bottom surface of the module, the bottom member including a first engagement projection and a second engagement projection;

a plurality of conductive terminals supported by the bottom member each conductive terminal including contact portions for connecting to circuits on a substrate; and a conductive shell movably attached to the bottom member, the conductive shell entirely surrounding at least a portion of a side surface of the module in the circumferential direction when the module is inserted into the module socket, the conductive shell including an engagement arm and contact portions for connecting to circuits on a substrate;

wherein both the first and second engagement projections oppose and flank the engagement arm, the conductive shell is movable in the vertical direction with respect to the bottom member when attached to the bottom member, and the first and second engagement projections respectively limit the vertical movement of the conductive shell with respect to the bottom member.

2. The module socket according to claim 1, wherein the conductive shell includes at least one elastic first engagement piece projecting inwardly into the module socket, the first engagement piece engaging a corresponding opposing engagement recess formed on the module side surface to keep the module in place within the module socket.

3. The module socket according to claim 2, wherein the elastic first engagement piece includes a tongue-shaped member having one end connected to the conductive shell, the conductive shell having an upper lip that extends outwardly at an angle, whereby pressure exerted on the lip, moves the tongue-shaped member out of engagement from the module recess.

4. The module socket according to claim 3, wherein the conductive shell further includes an elastic second engagement piece projecting inwardly into the module socket, the second engagement piece engaging a metal coating layer formed on the module side surface to thereby effect an electrical connection between the conductive shell and the module.

5. The module socket according to claim 1, wherein each terminal includes an elastic arm portion projecting upward from the bottom member for contacting a bottom surface of the module.

6. A camera module socket for receiving a camera module, comprising:

an insulative housing member, the housing member including a body portion extending between two opposing ends, the body portion further including a plurality of slots formed therein, each of the slots receiving a conductive terminal therein, each conductive terminal including a bottom tail portion for connecting to a circuit board and an opposing top contact portion that extends above the body portion, at least one of the housing member ends including a first pair of first and second stop members separated from each other vertically by an intervening space and projecting from the housing member end;

a conductive outer shell movably attached to the housing member at the opposing ends thereof, the conductive shell including a plurality of grounding springs formed therewith extending away from the conductive shell in a first direction for contacting a camera module inserted into the camera module socket, and at least a first engagement arm formed as part of the conductive shell and extending in a second direction, different from the first direction, the engagement arm being received within the intervening space on the housing member one end so as to permit movement of the conductive shell with respect to the housing member;

wherein the first and second stop members are spaced apart from each other vertically so as to limit vertical movement of the conductive shell with respect to the housing member.

7. The camera module socket according to claim 6, wherein the housing member other end includes a second pair of first and second stop members separated from each other by an intervening space and projecting from the housing member other end; and the conductive shell includes a second engagement arm therefrom, the second engagement arm being received within the intervening space on the housing member other end;

wherein the second pair of first and second stop members are spaced apart from each other vertically so as to limit vertical movement of the conductive shell with respect to the housing member.

8. The camera module socket according to claim 7, wherein each of the housing member end and other ends include an additional pair of first and second stop members, and the conductive shell includes an additional engagement arm extending therefrom.

9. The camera module socket according to claim 8, wherein each of the engagement arms includes a tongue-shaped member having one end connected to the conductive shell, the conductive shell having an upper lip that extends outwardly at an angle, whereby pressure exerted on the lip moves the tongue-shaped member over the first stop members.

* * * * *